US005152558A

United States Patent [19]

Smith et al.

[11] Patent Number: 5,152,558

[45] Date of Patent: Oct. 6, 1992

[54] LOCKSET ADAPTABLE FOR INSTALLATION AT MORE THAN ONE BACKSET DISTANCE

[75] Inventors: William D. Smith, Fair Oaks; Jaime Galindo, Hayward, both of Calif.

[73] Assignee: Schlage Lock Company, San Francisco, Calif.

[21] Appl. No.: 723,741

[22] Filed: Jul. 1, 1991

[51] Int. Cl.[5] ..... E05C 1/16

[52] U.S. Cl. ..... 292/1.5; 292/337; 292/173

[58] Field of Search ..... 292/1.5, 337, DIG. 60, 292/173

[56] References Cited

U.S. PATENT DOCUMENTS

| | | | |
|---|---|---|---|
| 2,674,481 | 4/1954 | Russell et al. | 292/169 |
| 2,905,495 | 9/1959 | Adamson | 292/244 |
| 2,961,264 | 11/1960 | Hillgren | 292/164 |
| 4,483,162 | 11/1984 | Dunphy et al. | 70/134 |
| 4,739,638 | 4/1988 | Lin | 70/129 |
| 4,759,576 | 7/1988 | Ching | 292/1.5 |
| 4,767,140 | 8/1988 | Lin | 292/1.5 X |
| 4,950,008 | 8/1990 | Fang | 292/1.5 X |
| 4,976,122 | 12/1990 | Doolan et al. | 70/134 |
| 4,979,768 | 12/1990 | Marotto et al. | 292/1.5 X |

*Primary Examiner*—Richard E. Moore

*Attorney, Agent, or Firm*—Robert F. Palermo

[57] ABSTRACT

A lockset is adaptable for installation at more than one backset distance including a bolt assembly which has a latch member and a separable drawbar located within a housing assembly, a portion of which is also made up of two relatively movable portions. Operation of the lock is standard in so far as extending and retracting the bolt is concerned, while adjustment of the backset distance is accomplished by simultaneously adjusting the lengths of the bolt assembly and the housing assembly. Visual indication of backset distance is provided as is adaptability without the use of tools. Bolt throw disablement is provided when the lockset is in the transfer position for changing backset.

3 Claims, 3 Drawing Sheets

Transfer Position
(Bolt Retracted)

Service Position
(Bolt Thrown)

LOCKSET ADAPTABLE FOR INSTALLATION AT MORE THAN ONE BACKSET DISTANCE

BACKGROUND OF THE INVENTION

This invention relates generally to door lock sets and more particularly to lock sets which are adaptable for installation at more than one backset distance.

The distance from the edge of a door to the axis of the knob is commonly called the backset. Most doors and locksets are made for either 2 $\frac{3}{8}$ in. or 2 $\frac{3}{4}$ in. backsets. Though less common, other backsets are also made. For installation or replacement of a lockset in an existing door, the predrilled door cavity and the backset distance of the lockset must be the same.

Manufacturing costs, inventory costs, and distribution costs are increased by the necessity for providing a multiplicity of locksets having different backset distances. Adjustable locksets which are adaptable for installation at more than one backset distance reduce these costs and improve convenience for the installer.

Adjustable locksets of the prior art commonly require some disassembly, often with special tools, in order to change the backset distance of the lockset. This is time-consuming and introduces a risk of lost parts or damage to the components of the lockset. Either or both of these occurrences can significantly increase the cost of installation or replacement of locksets.

The foregoing illustrates limitations known to exist in present devices and methods. Thus, it is apparent that it would be advantageous to provide an alternative directed to overcoming one or more of the limitations set forth above. Accordingly a suitable alternative is provided including features more fully disclosed hereinafter.

SUMMARY OF THE INVENTION

In one aspect of the present invention, this is accomplished by providing a lockset adaptable for installation at more than one backset distance, including a bolt assembly having an elongate latch member at a first end and a separable through-slotted drawbar at a second end; a housing assembly enclosing substantially all portions of the bolt assembly except for the end face surface of the latch member; provision for extending the latch member from the housing assembly to a locked position and for retracting the latch member to an open position; and a mechanism for congruently adjusting the lengths of the bolt assembly and the housing assembly.

The foregoing and other aspects will become apparent from the following detailed description of the invention when considered in conjunction with the accompanying drawing figures.

DETAILED DESCRIPTION

Figure 1:
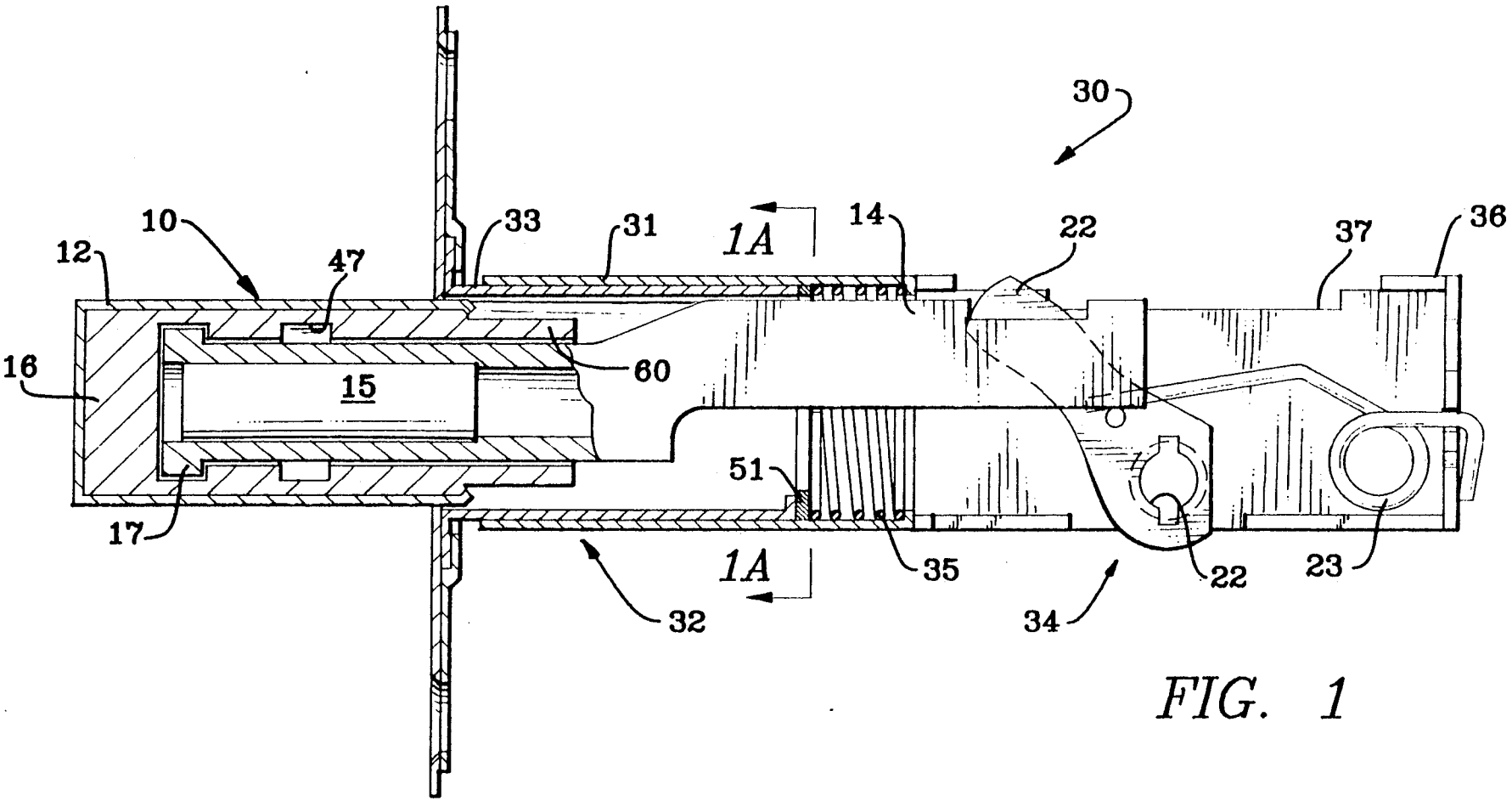
FIG. 1 is a schematic partially sectional view of one embodiment of the lockset of the present invention.
Figure 3A:
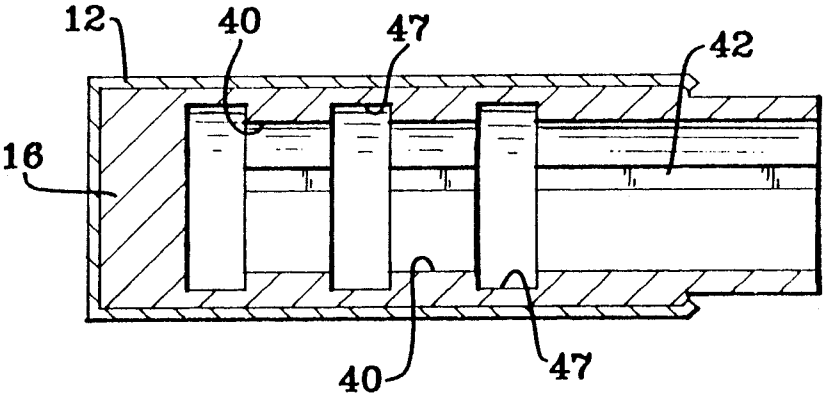
FIG. 3A is a schematic sectional view as in FIG. 3 to illustrate an alternative embodiment of the bolt body of the present invention.
Figure 3:
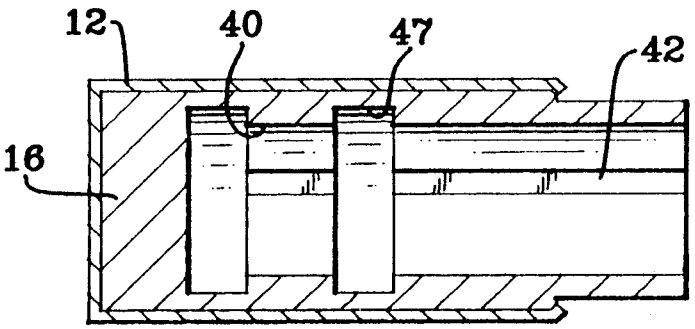
FIG. 3 is a schematic sectional view of the bolt body to show the transfer grooves and the bolt grooves for a dual backset lockset of the present invention.

FIG. 1 is a partially sectional view of one embodiment of a lockset of the present invention. Housing assembly 30 comprises front housing assembly 32 and rear housing assembly 34. Front housing assembly 32 is made up of front inner housing 33 and front outer housing 31. Rear housing assembly 34 comprises rear housing shell 36, rear housing slot 37, crank arm 22 which is journalled in housing shell 36, and crank arm spring 23. Rear housing shell 36 is rigidly attached to front outer housing 31 and is transversely penetrated by knob shaft bore 21, through crank arm 22, to permit rotation of the crank arm as desired. (For simplicity the knob shaft is not illustrated.) Latch member 10 is reciprocably mounted within front inner housing 33, and its reciprocable motion is imparted by crank arm 22 through drawbar 14. Note that latch member 10 comprises latch shell 12 and bolt body 16. Bolt body 16 has circumferential bolt grooves 47 and longitudinal transfer grooves 42 as illustrated in FIGS. 3 and 3A. Bolt body 16 also has bolt body extension 60 which incorporates bolt lock grooves 58 (shown in FIG. 1A). Drawbar 14 has a cylindrical cross section within bolt body 16 and has drawbar tabs 17 which engage with bolt grooves 47 to impart motion to the bolt body 16 in response to motion of crank arm 22.

Figure 1A:
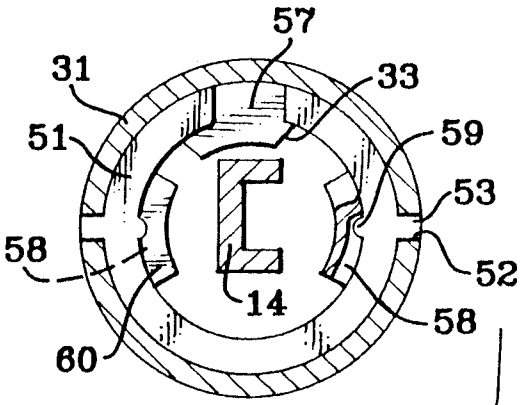
FIG. 1A is a schematic partially sectional view from line 1A—1A of FIG. 1 showing the lockset in the service position and the bolt throw disabling provision which prevails in the rotated transfer position.
Figure 1A:
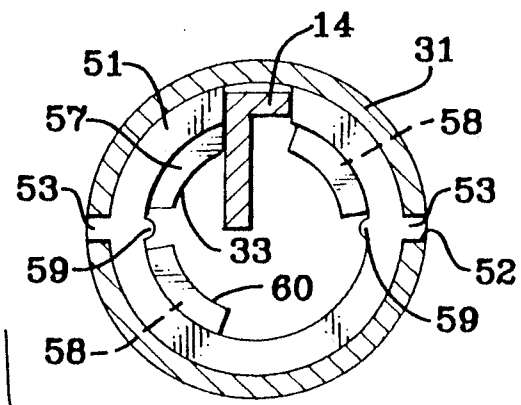

FIG. 1A presents views from line 1A—1A of FIG. 1 to show a feature by which the bolt throw, or axial movement of latch member 10 with respect to front inner housing 33, is disabled when the lockset is in the transfer position. Comparing the service position and transfer position, it can be seen first that front outer housing 31 has diametrically opposed slots 52 in which lock tabs 53 of lock washer 51 are held so that outer housing 31, lock washer 51 and drawbar 14 rotate together relative to front inner housing 33 and bolt extension 60. In the transfer position, the skirt 57 covers the opening in lock washer 51. This position of the skirt disables the bolt throw because it blocks the opening in lock washer 51 needed for movement of drawbar 14. FIG. 1 shows the close fit between drawbar 14 and front inner housing 33 when the bolt is in the thrown position. In addition, comparison of the service and transfer positions reveals the mechanism by which bolt body extension 60 is locked axially to front inner housing 33 through engagement of bolt lock grooves 58 in bolt body extension 60 with bolt disabling tabs 59 of lock washer 51. This prevents axial movement of bolt body 16 (shown in FIGS. 1, 3, and 3A) with respect to front inner housing 33 during transfer of the drawbar 14 between bolt grooves 47 (shown in FIGS. 1, 3, and 3A). From this, it is clear how skirt 57 and lock washer 51 disable the bolt throw in the transfer position and, conversely, disable transfer in the thrown position. Note that the illustrated transfer position in FIG. 1A shows the drawbar 14 cross section as it would appear in the retracted position.

Figure 2:
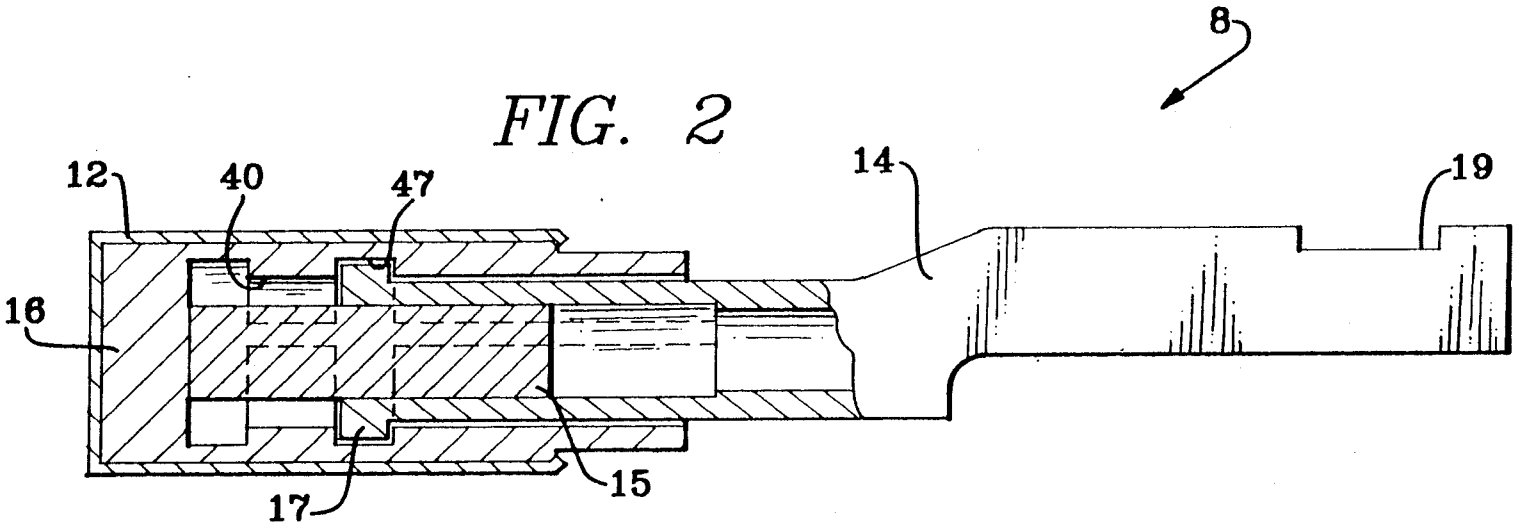
FIG. 2 is a schematic sectional view of the bolt assembly of the present invention.

FIG. 2 is a longitudinal cross section of bolt assembly 8 shown to further illustrate features of the invention. Bolt assembly 8 comprises drawbar 14 which connects to bolt body 16 by means of drawbar tabs 17 in bolt grooves 47. During extension or retraction motion of the bolt assembly drawbar tabs 17 act against locating stops 40 between bolt grooves 47. Drawbar 14 has a hollow cylindrical cross section within bolt body 16. This permits insertion of hardened steel insert 15, which prevents sawing through the latch member 10 in its extended position. Also seen here is crank slot 19 at the rearward end of drawbar 14. Crank slot 19 of drawbar 14, together with crank arm 22, provides a simplified linkage between the knob motions imparted through knob shaft bore 21, and latch member 10.

FIGS. 3 and 3A are schematic sectional views of two embodiments of the bolt body of the present invention. FIG. 3 represents a bolt body adaptable for two backsets, while FIG. 3A illustrates a bolt designed for three backset distances.

Examination of FIGS. 1 through 3A shows that the number and spacing of backset distances is determined by the number and spacing of bolt grooves 47. Preferably, two longitudinal transfer grooves 42 are located diametrically opposite each other within the bolt body 16 to permit insertion of drawbar 14, engagement of drawbar tabs 17, and retention of the drawbar in a particular axial location by means of locating stops 40. When drawbar tabs 17 are engaged in transfer grooves 42, the drawbar may be inserted or removed at will. By rotating the bolt body 16 with respect to drawbar 14, drawbar tabs 17 are turned into bolt grooves 47 where they are retained between locating stops 40.

Figure 4:
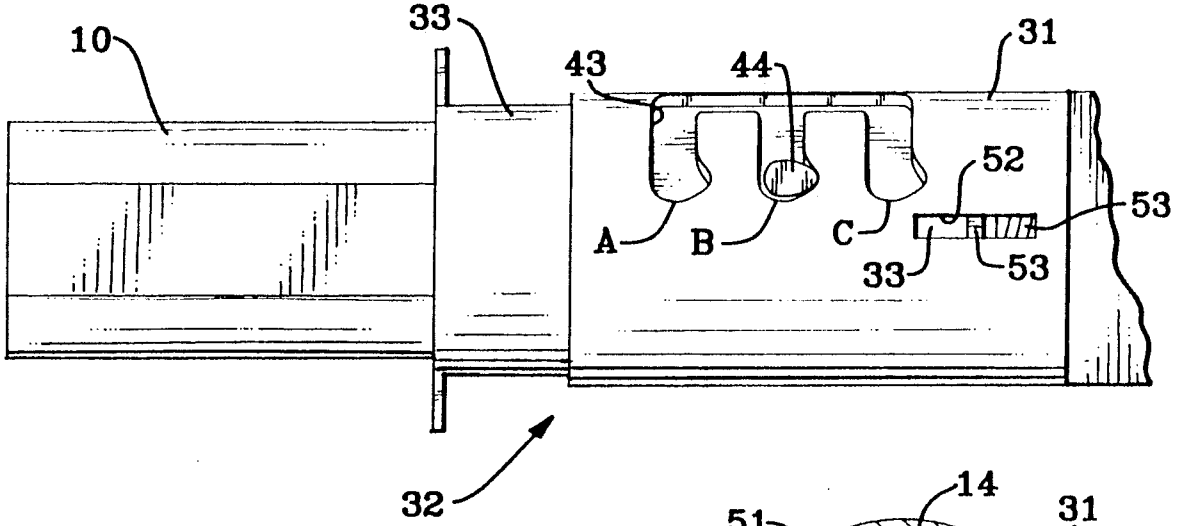
FIG. 4 is a schematic fragmentary view of the lockset of FIG. 1 to illustrate some external features of the lockset of the present invention.

FIG. 4 shows further detail of the lockset of the present invention. Latch member 10, in the locked position, protrudes from front inner housing 33 which, in turn, protrudes from front outer housing 31. Inner housing bias spring 35 (also shown in FIG. 1) urges front inner housing 33 axially outward from front outer housing 31 Slot 52 in front outer housing 31 is one of two diametrically opposed slots in the housing. Lock tabs 53 protrude through slot 52 to cause lock washer 51 (shown in FIGS. 1 and 1A) to rotate with the outer housing. Also see in slot 52 is front inner housing 33 where it abuts lock washer 51. Note that, since the lockset is adjusted for intermediate backset, the lock washer tabs 53 are in an intermediate position in slot 52. The housings are retained in engagement by inner housing transfer guide pin 44 which protrudes through transfer guide slot 43 of outer housing 31. This can be seen in FIG. 4 which also shows the engagement of crank arm 22 in crank slot 19 of drawbar 14. Thus, the bolt assembly 8 is retained within housing assembly 30 by crank arm 22. When installed in the door, the face plate (not shown) retains front inner housing 33 and, thereby, housing assembly 30.

Transfer guide slot 43 illustrated in FIG. 4 provides a stop for the rotation of the front outer housing 31 along with rear housing assembly 34 relative to front inner housing 33 and latch member 10. This provides a visual indication of axial and radial orientation within the lockset and assures alignment of drawbar tabs 17 with transfer grooves 42 to permit axial displacement of bolt body 16 with respect to drawbar 14. When the relative axial motion of bolt body 16 is completed, the housings are again rotated relative to each other so that inner housing transfer guide pin 44 moves circumferentially within the transfer guide slot 43 to retain the housing assembly 30 and the bolt assembly 8 at the desired length. The transfer guide detents a, b, and c correspond to bolt grooves 47 in FIGS. 3 and 3A. Thus, bolt assembly 8 and front inner housing 33 move congruently with respect to housing assembly 30. Locating stops 40 in bolt body 16 correspond to the spacing of transfer guide detents a, b, and c.

The assemblies illustrated in FIGS. 1 through 4 illustrate both dual backset and triple backset mechanisms. It should be noted that most lockset installations require either a 2 $\frac{3}{8}$ in. or 2 $\frac{3}{4}$ in. backset. However, there are some installations having 3 in. or other backset distances. Thus, the frequency with which the various backsets are encountered, will determine whether locksets adaptable for 2, 3, or even more bracket distances are provided.

To summarize the operation of the present invention, backset distance of the lockset is adjusted by rotating front inner housing 33 relative to front outer housing 31 as permitted by transfer guide slot 43 and inner housing transfer guide pin 44. Latch member 10 must rotate with front inner housing 33 because of their geometric configuration while drawbar 14 is constrained to rotate with the rear housing assembly 34 and front outer housing 31. This aligns drawbar tabs 17 with transfer grooves 42 within bolt body 16 so that the bolt body and drawbar may be moved axially with respect to each other. When drawbar tabs 17 are aligned with bolt grooves 47 at the desired bolt assembly length, the latch member and front inner housing are rotated again relative to the rear housing and front outer housing to engage the drawbar tabs against the locating stops 40 to thus congruently establish the desired lengths for bolt assembly 8 and housing assembly 30.

This invention provides the advantage of adjustability of the backset distance with no requirement for disassembly of the lockset and no requirement for tools. This simple field adjustability significantly reduces inventory costs, manufacturing costs, and installation costs. Further, along with its twist/pull (twist/push) adjustment mechanism, it also provides an external visual indication of the backset distance setting.

What is claimed is:

1. A lockset adaptable for installation at more than one backset distance, comprising:

a bolt assembly including an elongate latch member at a first end and a separable through-slotted drawbar at a second end;

a housing assembly enclosing substantially all portions of the bolt assembly except for the first end face surface of said latch member;

means for extending the latch member from the housing assembly to a locked position and for retracting said latch member to an open position; and an axial cavity in the bolt first end, said axial cavity having a plurality of axially spaced locating stops defined by a pattern of longitudinal and circumferential grooves in the wall of said axial cavity;

at least one radially protruding tab on said separable through-slotted drawbar, said tab being slidably engaged in said longitudinal and circumferential grooves and locatable therein between said axially spaced locating stops to define a plurality of lengths for said bolt assembly;

a telescopic cylindrical portion of said housing assembly comprising an inner housing member laterally enclosing the bolt first end and an outer housing member laterally enclosing said inner member and capable of rotating and telescoping thereon in conformity with the congruent movements of said bolt assembly so as to simultaneously adjust the lengths of both the bolt assembly and the housing assembly; and a slot in said outer housing member through which a guide pin on said inner housing member protrudes and provides a visual indication of the backset distance, said slot having a configuration such that it conforms with the configuration of the rotary and telescopic motion permitted for the bolt assembly.

2. A housing assembly for locksets which are adaptable for installation at more than one backset distance, comprising:

a rear housing assembly comprising a rear housing shell and means for imparting reciprocable motion to a drawbar a second end of which is contained within said rear housing shell;

a front housing assembly connected to a first axial end of said rear housing assembly and comprising a front outer housing laterally enclosing a front inner housing, said front inner housing laterally enclosing a latch member and a first end of said drawbar;

means for permitting telescopic and rotational motion of said front inner housing relative to said front outer housing so as to adjust the length of said housing assembly; and a radial pin on the front inner housing which protrudes through an opening in the front outer housing, said opening having a configuration such that it limits the extent and direction of relative motions between said front inner housing and front outer housing, said relative housing positions being indicated by the visible end of the radial pin on said front inner housing.

3. A housing assembly for locksets which are adaptable for installation at more than one backset distance, comprising:

a rear housing assembly comprising a rear housing shell ad means for imparting reciprocable motion to a drawbar a second end of which is contained within said rear housing shell;

a front housing assembly connected to a first axial end of said rear housing assembly and comprising a front outer housing laterally enclosing a front inner housing, said front inner housing laterally enclosing a latch member and a first end of said drawbar;

means for permitting telescopic and rotational motion of said front inner housing relative to said front outer housing so as to adjust the length of said housing assembly; and means for disabling bolt throw motion of said latch member when said front housing assembly is configured in a transfer position.

* * * * *